US006247249B1

(12) United States Patent
Lindqvist

(10) Patent No.: US 6,247,249 B1
(45) Date of Patent: Jun. 19, 2001

(54) SHOE SYSTEM WITH A RESILIENT SHOE INSERT

(75) Inventor: Wilhelm Ove Lindqvist, Stockholm (SE)

(73) Assignee: Trackguard Inc., Portland, OR (US)

( * ) Notice: Subject to any disclaimer, the term of this patent is extended or adjusted under 35 U.S.C. 154(b) by 0 days.

(21) Appl. No.: 09/326,729

(22) Filed: Jun. 7, 1999

(30) Foreign Application Priority Data

May 11, 1999 (SE) ..... 99017147

(51) Int. Cl.[7] ..... A43B 13/18; A43B 13/14; A43B 13/28; A43B 21/36; A61F 5/14

(52) U.S. Cl. ..... 36/28; 36/31; 36/35 R; 36/36 A; 36/27; 36/38; 36/44; 36/143; 36/151

(58) Field of Search ..... 36/28, 27, 25 R, 36/29, 31, 36 A, 38, 82, 72 B, 142, 143, 151, 88, 92, 102, 103, 105, 107, 43, 44, 35 R, 30 R, 3 R, 3 B

(56) References Cited

U.S. PATENT DOCUMENTS

| | | | | |
|---|---|---|---|---|
| 324,065 | | 8/1885 | Andrews . | |
| 1,403,970 | | 1/1922 | Lioy . | |
| 2,814,132 | | 11/1957 | Montoscuro . | |
| 3,142,910 | | 8/1964 | Levine . | |
| 4,756,095 | | 7/1988 | Lakic | 36/2.6 |
| 4,890,397 | | 1/1990 | Harada et al. | 36/30 R |
| 5,138,776 | * | 8/1992 | Levin | 36/38 |
| 5,159,767 | * | 11/1992 | Allen | 36/27 |
| 5,187,883 | | 2/1993 | Penney | 36/35 R |
| 5,282,325 | * | 2/1994 | Beyl | 36/27 |
| 5,341,581 | * | 8/1994 | Huang | 36/3 B |
| 5,367,790 | | 11/1994 | Gamow et al. | 36/27 |
| 5,381,608 | | 1/1995 | Claveria | 36/35 R |
| 5,396,718 | * | 3/1995 | Schuler et al. | 36/38 |
| 5,435,079 | | 7/1995 | Gallegos | 36/38 |
| 5,515,622 | * | 5/1996 | Lee | 36/3 B |
| 5,596,819 | * | 1/1997 | Goldston et al. | 36/35 R |
| 5,701,686 | | 12/1997 | Herr et al. | 36/27 |
| 6,029,374 | * | 2/2000 | Herr et al. | 36/27 |

FOREIGN PATENT DOCUMENTS

| | | | | |
|---|---|---|---|---|
| 1487256 | * | 5/1967 | (FR) | 36/44 |
| 2246280 | * | 1/1992 | (GB) | 36/82 |

OTHER PUBLICATIONS

Visco Elastic Insole; *IEM Medical Technologies, Inc.* (www.globaltowne.com) (Jan. 1998 or earlier).
DynaStep Inserts; *Dr. Scholls* (www.drscholls.com) (Jan. 1998 or earlier.).

* cited by examiner

*Primary Examiner*—Paul T. Sewell
*Assistant Examiner*—Anthony Stashick
(74) *Attorney, Agent, or Firm*—Fasth Law Offices; Rolf Fasth

(57) ABSTRACT

The shoe system comprises a shoe that has a toe section and a heel portion. A shoe sole is disposed inside the shoe and has a groove defined therein. The groove extends angularly from an upper surface of the shoe sole rearwardly towards the heel portion of the shoe. A wedge section is removably attached to the shoe sole. A shoe insert has a stiff first member and a resilient second member attached to the first member. The second member is inserted into the groove. The second member has one side that may be thicker than the opposite side so that the second member is only twistable in one direction.

5 Claims, 2 Drawing Sheets

FIG. 1
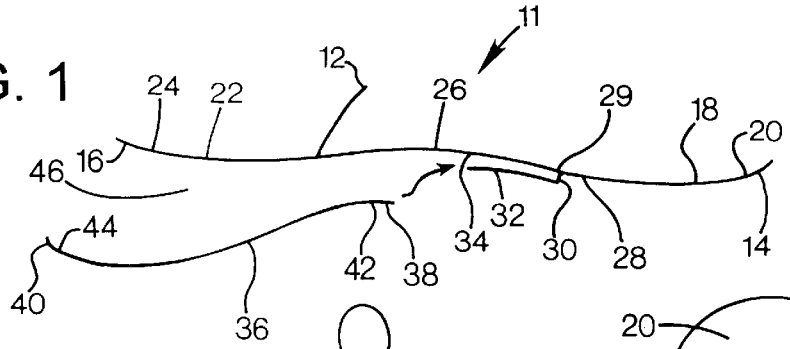
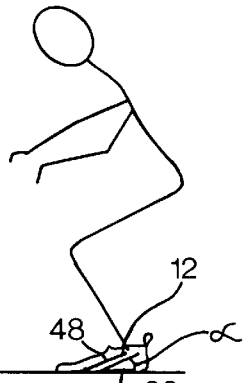
FIG. 6
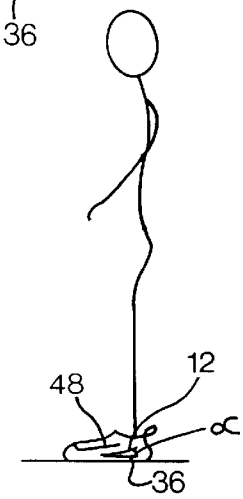
FIG. 5
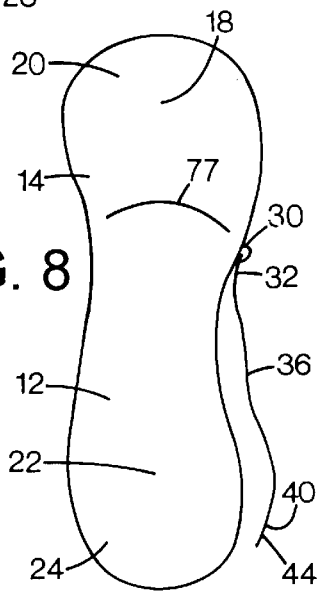
FIG. 8
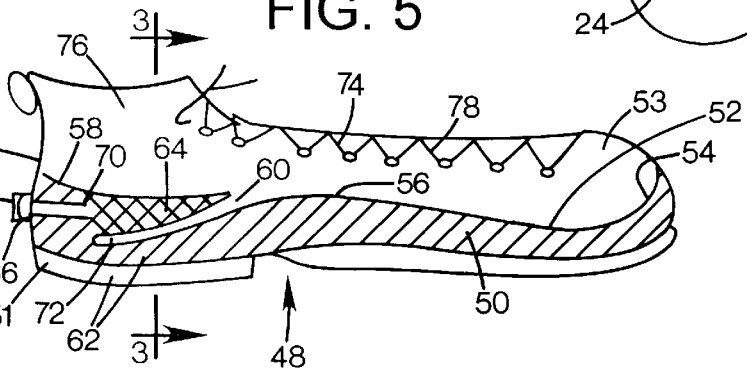
FIG. 2
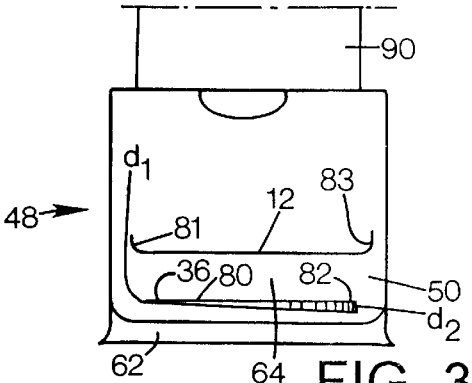
FIG. 3
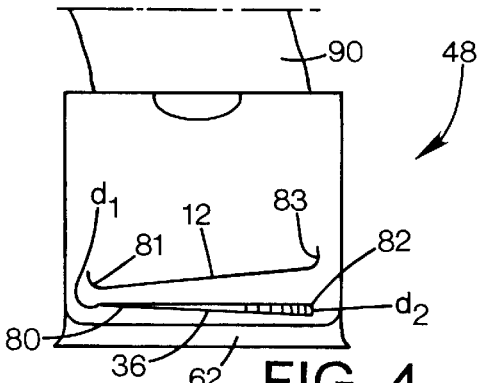
FIG. 4

SHOE SYSTEM WITH A RESILIENT SHOE INSERT

TECHNICAL FIELD

The present invention relates to a resilient shoe insert that is insertable into a shoe system.

BACKGROUND AND SUMMARY OF THE INVENTION

Developers of elastic shoes and shoe soles are confronted with the problem of back injury and releasing the stored energy in the shoe sole in a manner which improves walking and running economy while at the same time achieving adequate bio-mechanical shoe stability and cushioning. Many shoe manufacturers have concentrated their effort on shock absorption by increasing the thickness of the shoe sole. This has resulted in a slight change of the angle between the ankle and the foot that may weaken the tendons of the foot. This change of the angle may also lead to instability and reduced bio-mechanical effect.

Many efforts have been made to develop an effective spring mechanism for the shoe or shoe sole. However, the earlier proposed spring designs for shoe soles have not been entirely satisfactory. Despite many elaborate shoe sole solutions, back injuries and other injuries are still common due to poorly designed shoes. Injuries due to poor shoe designs are particularly common in sports and heavy duty work activities.

One important function of a shoe, such as a running shoe, is to protect the foot from the stresses of running. The forces and motions that occur in different sports vary greatly. Because of these differences it is important that active participation in varied sports require varied shoes. For example, tennis and other racquet sports require much side-to-side motion and the shoe must provide lateral stability. If the shoe is unstable and has high heel elevation when the athlete is moving from one side to another the likelihood is great the athlete may suffer an ankle sprain. The majority of shoes are not well designed. Some insufficiencies of the current shoe designs may be overcome by the present invention.

The shoe system of the present invention comprises a shoe that has a toe section and a heel portion. A shoe sole is disposed inside the shoe and has a groove defined therein. The groove extends angularly from an upper surface of the shoe sole rearwardly towards the heel portion of the shoe. A wedge section is removably attached to the shoe sole. A removable shoe insert has a stiff first member and a resilient second member attached to the first member. The second member maybe inserted into the groove. The second member has one side that may be thicker than the opposite side so that the second member is only twistable in one direction. The stiffness difference may also be achieved by attaching flexible member at an angle relative the longitudinal direction of the shoe insert.

BRIEF DESCRIPTION OF THE DRAWINGS

FIG. 1 is a side view of a shoe insert of the present invention;

FIG. 2 is a side view of a shoe adapted to receive the shoe insert of FIG. 1;

FIG. 3 is a rear view of the shoe in a vertical position along line 3—3 of FIG. 2 with the shoe insert of FIG. 1 placed inside the shoe;

FIG. 4 is a rear view of the shoe along line 3—3 of FIG. 2 when the ankle is disposed in an inwardly sloping position;

FIG. 5 is a side view of a person standing straight up on the shoe of the present invention;

FIG. 6 is a side view of a person standing on the shoe and leaning forward;

FIG. 8 is a top view of the shoe insert;

DETAILED DESCRIPTION

Figure 7:
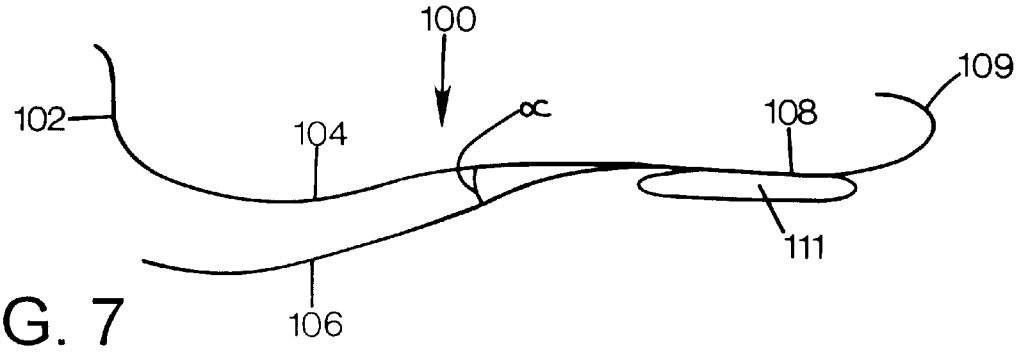
FIG. 7 is a side view of an alternative embodiment of the shoe insert of the present invention.

With reference to FIGS. 1–8, the present invention is a shoe system having a resilient shoe insert 11 including a stiff first support member 12 that may be made of a carbon fiber reinforced composite material or any other suitable material that is relatively stiff. The first member 12 has a flexible and bendable fore end 14 and a stiff aft end 16. The fore end 14 has a cavity portion 18 that terminates in a slightly upwardly curved end section 20. It is to be understood that the fore end is preferably made of a flexible and bendable material that may be cut to size by a pair of scissors to tailor the shape of the fore end 14 to the shape of the shoe system and the foot. Another reason for using the flexible material at the fore end 14 is so that the toes of the foot may fully cooperate with the fore end 14 when walking and moving about.

The stiff aft end 16 has a cavity portion 22 that terminates in a slightly upwardly curved end section 24. A stiff middle section 26 of the member 12 is convex shaped relative to the concave cavity portions 18, 22. A holder mechanism 26 is attached to an underside 28 of the first member 12. The holder mechanism 26 includes a short end wall 30 that is perpendicular to the member 12 and a long support wall 32 that is perpendicularly attached to the end wall 30 to that the underside 28, the end wall 30 and the support wall 32 define a receiving pocket 34 that is facing the aft end 16. Preferably, the end wall 30 is attached to the underside 28 on the first member 12 at a point 29 that is at a front end portion of the middle section 26. In the preferred embodiment, the first member 12 is stiff all the way from the place of attachment at the point 29 of the end wall 30 to the end section 24 and bendable from the point 29 to the end section 20.

A second member 36 has a fore end 38 that is insertable into the receiving pocket 34. More particularly, the second member has the fore end 38 and an opposite aft end 40. The fore end 38 has a slightly downwardly curved end section 42 and the aft end 40 has an upwardly curved end section 44 so that the second member 36 is somewhat S-curved. When the second member 36 is inserted into the receiving pocket 34, the end section 44 is aligned with the end section 24 of the first member 12 so that a gap 46 is formed between the first member 12 and the second member 36.

An important feature of the present invention is that the second member 36 is springy and resilient while the first member 12 is generally stiff except for a bendable toe portion. As is explained below, a heavier person may select a stiffer second member than a lighter person to prevent the second member 36 from abutting or resting against the first member 12 when the heavier person is standing on the first member 12 with the second member 36 inserted into the receiving pocket 34. Preferably, the second member 36 should be sufficiently stiff so that the second member 36 does not bottom out even though the person is actively using the shoe insert 11 disposed in the shoe. For example, when a person is standing straight up (as is shown in FIG. 5) so that the shoe insert 11 is subjected to the greatest weight, the first member 12 forms a minimum angle alpha relative to the second member 36 but the angle should not be zero. The angle alpha increases when the person bends his/her knees or leans forward, as is shown in FIG. 6, so that an increasing amount of the body is supported by the front portion of the foot and less weight is exerted upon the second member 36. It is also preferred that the stiffness and the shape of the second member 36 are such that the first member 12 does not bottom out even though the person is jumping or actively using a shoe 48.

Other factors that determine what stiffness to use for the second member 36 include the type of activity the shoe is going to be used for and whether the walking/running surface is hard, soft and uneven. The shape of the second member 36 may also be varied depending on the needs of the user. For example, a second member having a more bent fore end creates a bigger gap 46 between the second member and the first member when the second member is inserted into the holder 32. A bigger gap 46 may reduce the risk of bottoming out and also changes the angle between the foot and the ankle.

Because the first member 12 is stiff, the shape of the first member is maintained and the foot is provided a full support although the second member 36 may move relative to the first member 12. In other words, the first member 12 provides good support to the foot although the second member 36 may be compressed against the first member 12 and later permitted to move back to the relaxed expanded position depending upon how the shoe is used in, for example, a sport activity.

As best shown in FIG. 2, the shoe 48 may have a preformed shoe sole 50 that has an upper surface 52 that is shaped to snugly receive the shoe insert 11. The shoe 48 has a heel section 51 and a toe portion 53. The shoe sole 50 is preferably made of a flexible material such as rubber or plastic. The upper surface 52 has an upwardly curved front portion 54, a convex middle portion 56 and a slightly upwardly curved aft portion 58 to support the sections 20, 26 and 24, respectively, of the first member 12.

An important feature is that the shoe sole defines an angular curved groove 60 that is dimensioned to receive the second member 36. The groove 60 extends backwardly and angularly downwardly towards a heel 62 of the shoe 48. A triangular wedge 64 is disposed between the upper surface 52 and the groove 60. The wedge 64 is removably attached to the sole 50 so that the wedge can 64 easily be removed to make it convenient to insert and remove, particularly, the second member 36 of the shoe insert 11. The wedge 64 is made of a very flexible material so when the second member 36 is urged towards the first member 12 by the weight of the user, the wedge 64 is deformed and compressed accordingly.

The shoe 48 may also be used with the shoe insert 11 placed on the upper surface 52 but with the wedge 64 removed. An one-way valve 66 is attached to a back end 68 of the shoe 48. A channel 70 may be defined in the shoe sole 50 so that the valve 66 is in fluid communication with a space 72 that is formed between the first member 12 and the second member 36. Of course, the wedge 64 may extend all the way back to the section 58 of the shoe sole 50 so that there is no need for a channel.

When the second member 36 is pressed towards the first member 12 so that the shoe insert 11 is in a compressed position, an over pressure is formed in the space 72 that may flow into the channel 70 and out through the valve 66 to provide good mechanical ventilation inside the shoe. Any under pressure that may be formed in the space 72 when the second member 36 is permitted to move from the compressed position back to its original expanded position away from the first member 12 may be equalized by sucking in air from an upper part 74 of the shoe 48 such as the opening 76 or the open areas adjacent to the shoe laces 78. It should be understood that the valve 66 may also be a two-way valve so that the valve may be used to compensate for both over-pressure and under-pressure in the space 72. In this way, the valve 66 may function to circulate and possibly bring in or suck cool air into the inside of the shoe when the second member 36 is permitted to expand from the compressed position. A filter 79 may also be placed in the valve 66 to prevent dust and other undesirable particle from entering into the inside of the shoe 48 when the shoe inlet 11 is expanding.

As best shown in FIG. 3, the first member 12 and the second member 36 are substantially parallel when a person is standing straight up without leaning sideways. The first member 12 may have vertical side walls 81, 83 to prevent the foot from sliding sideways and put undue pressure on the side wall of the shoe. However, when the person moves in a sideways direction so that an ankle 90 is in an inclined position, the weight distribution of the shoe may be uneven, as shown in FIG. 4, so that the second member 36 is twisted slightly relative to the stiff first member 12 to create a torsion force about an outside portion 82 of the second member 36. The second member 36 may have a first thickness $d_1$ on an inside portion 80 and a second thickness $d_2$ on the outside portion 82. The second thickness $d_2$ is greater than the first thickness $d_1$ so that the second member 36 is only permitted to twist relative to the stiff first member 12 when the ankle 90 is leaned inwardly, as shown in FIG. 4, if the shoe 48 shown is a shoe for the right foot. In other words, the second thickness at the outside portion 82 is sufficiently thick to make the outside portion 82 of the second member 36 rigid enough to prevent any relative movement between the first member 12 and the second member 36 at the outside portion 82. Because the inside portion 80 is twistable, there is less need to bend the ankle relative to the foot, thus exposing the ankle to less strain, when the person is standing with the legs wide apart. For example, it is common to stand with the legs wide apart when waiting to return a serve in tennis. Another situation that may put extra strain on the ankle is when running along a surface that is sloping sideways. The twisting of the inside portion 80 generally results in less risk of straining the foot because the angle change between the ankle and the foot as a result of leaning the ankle inwardly is reduced.

FIG. 7 shows an alternative embodiment of the present invention. The shoe insert 100 includes an extended back support section 102 that extends above the heel of the foot to partly protect the Achilles tendon and the heel of the foot. The support section 102 reduces any excessive rubbing between the heel of the foot and the rear inside wall of the shoe. Excessive rubbing may cause blisters as the shoe insert 100 is compressed and expanded. Similar to the shoe insert 11, the shoe insert 100 has a stiff first member 104, a resilient second member 106 and a bendable and flexible fore end 108 that may terminate at a toe portion 109 that extends over the toes of the foot to protect the toes while the toe portion 109 may follow the movement of the shoe insert. A resilient rubber pad may be adhered to a bottom side of the fore end 108 to provide extra comfort. The first member 104 and the second member 106 form an angle alpha therebetween. This embodiment is particularly useful for working shoes and other types of heavy duty boots.

As best shown in FIG. 8, a transition area 77 between the first member 12 and the soft and flexible fore end 14 may be a curved section that is formed according to the support area of the foot that is disposed behind the toes.

Figure 9:
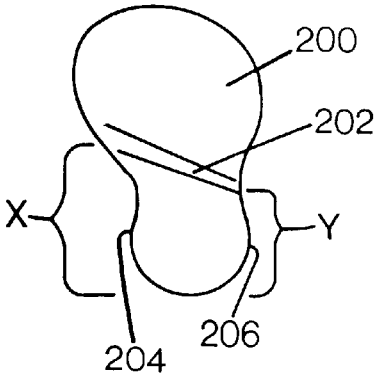
FIG. 9. is a top view of a second embodiment of a shoe insert for the right shoe.
Figure 10:
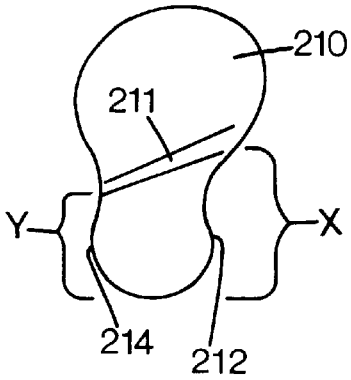
FIG. 10 is a top view of the second embodiment of the shoe insert for the left shoe.
Figure 11:
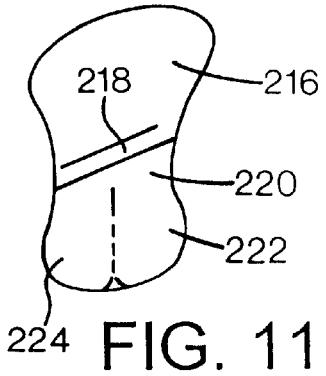
FIG. 11 is a bottom view of a third embodiment of a shoe insert.
Figure 12:
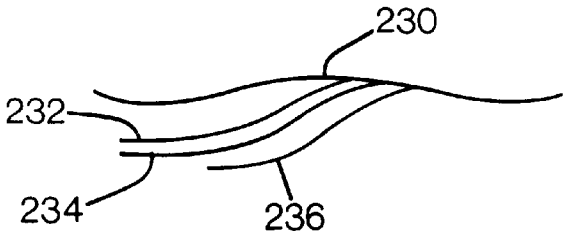
FIG. 12 is a side view of a fourth embodiment of a shoe insert.

FIG. 9 is a top view of a second embodiment of the shoe insert of the present invention. A shoe insert 200 has a transition area 202 (that is equivalent to the transition area 77 of FIG. 8) that extends at an angle so that a distance (x) at an inside 204 of the shoe insert 200 is longer than a distance (y) at an outside 206. In other words, the flexible member is longer at the inside 204 than the outside 206 so that the inside 204 may flex (as shown in FIG. 4) while the outside 206 is relatively stiff. Similarly, FIG. 10 shows a top view of a shoe insert 210 for the left shoe that has a transition area 211 and an inside 212 that has a length (x) that is longer than a length (y) of an outside 214. FIG. 11 is a bottom view of a third embodiment of the present invention. A shoe insert 216 has an angular transition area 218 in addition to a flexible member 220 that has a softer inside portion 222 and a stiffer outside portion 224. In the third embodiment, it is not necessary that the transition area extends at an angle because the inside portion 222 is already softer than the outside portion 224. FIG. 12 is a side view of a shoe insert 230 having a plurality of flexible members 232, 234, 236 attached to an underside 238 of the shoe insert 230 so that both the resiliency and the resiliency on the inside and the outside may be adjusted to the specific needs of the user of the shoe insert 230.

While the present invention has been described in accordance with preferred compositions and embodiments, it is to be understood that certain substitutions and alterations may be made thereto without departing from the spirit and scope of the following claims.

I claim:

1. A shoe system, comprising:

a shoe having a toe section and a heel portion, the shoe having an opening defined therein;

a shoe sole disposed inside the shoe, the shoe sole having a groove defined therein, the groove extending angularly from an upper surface of the shoe sole rearwardly towards the heel portion of the shoe;

a wedge section removably attached to the shoe sole at the groove; and a shoe insert having a stiff first member and a resilient second member attached to the first member, the second member being inserted into the groove defined in the shoe sole the first member having a holder attached to an underside of the first member, the holder having an insert opening defined therein, the second member being inserted into the insert opening.

2. The shoe system according to claim 1, wherein the second member has a first side and an opposite second side, the first side has a first thickness and the second side has a second thickness, the first thickness is greater than the second thickness.

3. The shoe system according to claim 1, wherein the shoe has a valve at the heel portion, a channel is in fluid communication with the valve and the inside of the shoe to permit air to flow from the inside of the shoe out through the valve.

4. The shoe system according to claim 1, wherein the first member has a flexible concave fore end connected to the first member at the holder in an transition area, the transition area being curved.

5. A shoe system, comprising:

a shoe having a toe section and a heel portion, the shoe having an opening defined therein;

a shoe sole disposed inside the shoe, the shoe sole having a groove defined therein, the groove extending angularly from an upper surface of the shoe sole rearwardly towards the heel portion of the shoe; and a shoe insert having a stiff first member and a resilient second member attached to the first member, the second member being resilient relative to the first member and being inserted into the groove defined in the shoe sole, the resilient second member having a first elongate side extending along the resilient second member and an opposite second elongate side, the first elongate side having a first thickness and the second elongate side having a second thickness, the first thickness being greater than the second thickness, the first member having a holder attached to an underside of the first member, the holder having an insert opening defined therein, the second member being removably inserted into the insert opening.

* * * * *